United States Patent [19]

Tsubota et al.

[11] Patent Number: 4,495,270

[45] Date of Patent: Jan. 22, 1985

[54] COLOR DIFFUSION TRANSFER PHOTOGRAPHIC ELEMENT

[75] Inventors: Motohiko Tsubota; Masakazu Moriguchi, both of Kanagawa, Japan

[73] Assignee: Fuji Photo Film Co., Ltd., Kanagawa, Japan

[21] Appl. No.: 444,912

[22] Filed: Nov. 29, 1982

Related U.S. Application Data

[63] Continuation-in-part of Ser. No. 247,456, Mar. 25, 1981, abandoned.

[30] Foreign Application Priority Data

Mar. 25, 1980 [JP] Japan ..... 55-37846

[51] Int. Cl.[3] ..... G03C 7/00

[52] U.S. Cl. ..... 430/218; 430/446; 430/598

[58] Field of Search ..... 430/218, 239, 223, 217, 430/242, 446, 487, 598, 559, 409

[56] References Cited

U.S. PATENT DOCUMENTS

| | | | |
|---|---|---|---|
| 2,648,604 | 8/1955 | Welliver et al. | 430/487 |
| 3,161,506 | 12/1964 | Becker | 430/218 |
| 4,110,113 | 8/1978 | Melzer et al. | 430/242 |

*Primary Examiner*—John E. Kittle
*Assistant Examiner*—John L. Goodrow
*Attorney, Agent, or Firm*—Sughrue, Mion, Zinn, Macpeak, and Seas

[57] ABSTRACT

A color diffusion transfer photographic element comprising (a) a photosensitive element containing at least one photosensitive silver halide emulsion layer combined with a dye releasing redox compound, (b) a dye image receiving element, and (c) an alkaline processing composition element where the alkaline processing composition element contains (1) a developing agent having a one-electron oxidation-reduction potential of −80 mV to −200 mV with respect to a saturated calomel electrode at a pH of 11.0, and (2) at least one of the compounds represented by the following general formula (I):

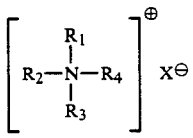

(I)

where $R_1$, $R_2$, $R_3$ and $R_4$, which may be the same or different, each represents an alkyl group, a substituted alkyl group, an alkenyl group, an aryl group or a substituted aryl group, and $X^-$ represents an anion.

5 Claims, No Drawings

COLOR DIFFUSION TRANSFER PHOTOGRAPHIC ELEMENT

CROSS REFERENCE TO RELATED APPLICATION

The present invention is a continuation-in-part application Ser. No. 247,456 filed Mar. 25, 1981, now abandoned.

FIELD OF THE INVENTION

The present invention relates to color photographic elements and, particularly, to color diffusion transfer photographic elements.

BACKGROUND OF THE INVENTION

In color diffusion transfer photographic elements, a method of effectively obtaining image densities is one of the very important technical factors in the field of color diffusion transfer photographic materials, for the purpose of, for example, (a) obtaining sharp images, (b) obtaining images in a moment as far as is possible by reducing the thickness of the photosensitive material as far as is possible, (c) improving sharpness byreducing the thickness of the layer as far as is possible similarly to (b) to shorten the diffusion distance of (d) producing color diffusion transfer phosotraphic elements at a low price, etc.

There are two major systems in instant photography at present. One is a system where dye developers are used (for example, U.S. Pat. Nos. 3,649,265, 3,161,506, 3,173,786, 3,253,915, etc.) and the other is a system which uses dye-releasing redox compounds (for example, U.S. Pat. No. 4,110,113).

These two different types of systems are essentially different in the manner of forming images and in the compositions of the photographic elements and developers used; as a consequence, the problems encountered and the consideration involved with these two different types of systems are quite different.

Dye developers which contain in the same molecule both the chromophoric system of a dye and a photographic silver halide developing moiety function both as a silver halide developing agent and as a dye in photographic diffusion transfer systems.

Dye developers are characterized by the art as being relatively non-diffusible in colloid layers such as hydrophilic organic colloids used in photographic emulsions at a neutral pH. However, they become diffusible in photographic elements in the presence of alkaline processing solutions. Thus, when an alkaline processing solution is applied to an exposed photographic element of the dye developer type, silver halide in exposed regions is developed and contiguous dye developers are immobilized, whereafter dye developers from unexposed (and undeveloped) areas of the photographic element diffuse and transfer to a receiving layer to yield a positive dye developer image. Such effects are described in U.S. Pat. No. 3,253,915.

In distinction to a dye developer base system as above explained, in a system where dye releasing redox compounds are used, the dye releasing redox compounds are mobilized, i.e., when a diffusion transfer photographic unit containing a dye releasing redox compound is imagewise exposed and developed in the presence of photosensitive silver halide emulsion, the dye releasing redox compound is oxidized in proportion to the amount of developed silver halide, the oxidized dye releasing redox compound is decomposed into a dye moiety and a non-diffusible moiety by an alkaline processing solution, and the dye moiety is mobilized and transferred to a receiving layer to yield a transfer dye image.

As a specific example, a cyan dye developer which theoretically develops only red-sensitive silver halide emulsion will also develop blue-sensitive or green-sensitive silver halide emulsion if development due to yellow and magneta dye developers, respectively, has not been completed by the time the cyan dye developer reaches these emulsions. Such development is obviously highly undesirable as such results in inter-image effects and it is highly desirable to provide a transfer system in which the dye is not attached to a "reactive" moiety as in a dye developer system so that the dye can diffuse throughout the system without becoming immobilized in the undesired or wrong emulsion layer.

To eliminate such undesirable inter-image effects, non-diffusible couplers which release a dye, i.e., dye releasing redox compounds, are used.

Reflecting the substntial difference in approach to forming images between the two systems, various problems which have been overcome in the dye developer system have also arisen in the dye releasing redox compound system, though due to different reasons.

For example, dye developers provide best photographic effects when used in combination with a hydroquinone type developing agent as taught in U.S. Pat. No. 3,253,915.

However, if hydroquinone developing agents are used together with dye releasing redox compounds, photographic properties are substantially harmed.

Further, it has been mentioned that onium compounds as disclosed in U.S. Pat. No. 3,161,506 are preferably used in formation of dye developer images. According to the disclosure of U.S. Pat. No. 3,161,506, the onium compounds interact with the dye developers to form salts thereof and the improvements in reduced color contamination, color drop off and minimum density obtained by their use are are at least due in part to the effect of such salt formation on the solubility and diffusibility of the dye developers. The onium compounds temporarily delay the migration of the dye developers so that the initial diffusion rates of the dye developers are reduced, yet more of the dye developers transfers from less exposed areas to increase the density. In this case, the onium compounds are employed in a large amount sufficient to form salts of the onium compounds, i.e., 0.2 to 15%, in an alkaline processing solution.

For color diffusion transfer photographic elements using a silver halide developing agent capable of causing cross-oxidation of a dye releasing redox compound, a method of increasing the activity of the silver halide developing agent capable of causing cross-oxidation of the above-described dye releasing redox compound, namely a method using the above-described silver halide developing agent having a low oxidation-reduction potential, is known as a method of obtaining images at a moment as far as is possible. However, since the silver halide developing agent is used in this case, cross-oxidation of the dye releasing redox compound with a non-electron oxidation product of the silver halide developing agent is difficult to carry out and, consequently, sufficient image densities are difficult to obtain.

Namely, when a silver halide developing agent having a low oxidation-reduction potential is used, the development rate of the coated silver halide becomes high, but cross-oxidation of the oxidation product of the silver halide developing agent with the dye releasing redox compound does not sufficiently advance and, consequently, images having a sufficient density cannot be obtained.

The present invention is, in essence, based on the discovery that when dye releasing redox compounds are used in combination with 1-phenyl-3-pyrazolidones or aminophenols and ammonium compounds in such an amount less than that as used in U.S. Pat. No. 3,161,506 that would not interact with dye releasing redox compounds and could thus not form salts of the ammonium compounds, excellent photographic properties are obtained.

SUMMARY OF THE INVENTION

An object of the present invention is to provide a color diffusion transfer photographic element which rapidly forms images having a high image density using a silver halide developing agent having a low oxidation-reduction potential.

Further, another object of the present invention is to provide an alkaline processing composition for increasing image densities and/or shortening the time for image formation in a color diffusion transfer photographic element.

The above-described objects are attained with a color diffusion transfer photographic element comprising (a) a photosensitive element containing at least one photosensitive silver halide emulsion layer combined with a dye releasing redox compound, (b) a dye image receiving element, and (c) an alkaline processing composition element, wherein the alkaline processing composition element contains (1) a developing agent having a one-electron oxidation-reduction potential of −80 mV to −200 mV with respect to a saturated calomel electrode at a pH of 11.0 and (2) at least one of the compounds represented by the following general formula (I):

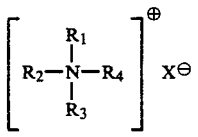

(I)

where $R_1$, $R_2$, $R_3$ and $R_4$, which may be the same or different, each represents an alkyl group, a substituted alkyl group, an alkenyl group, an aryl group or a substituted aryl group and $X^{\ominus}$ represents an anion.

DETAILED DESCRIPTION OF THE INVENTION $R_1$, $R_2$, $R_3$ and $R_4$ each represents an alkyl group or a substituted alkyl group. Preferably, $R_1$, $R_2$, $R_3$ and $R_4$ each represents an alkyl group having 1 to 20 carbon atoms (for example, a methyl group, an ethyl group, an n-propyl group, an isopropyl group, an n-butyl group, a t-butyl group, a cyclohexyl group, a decyl group, a dodecyl group or a hexadecyl group, etc.), which may be substituted with one or more substituents such as a halogen atom (for example, a fluorine atom, a chlorine atom or a bromine atom, etc.), an aryl group or a substituted aryl group (for example, a phenyl group, a 4-methylphenyl group, a 2-chlorophenyl group, a 3-methoxyphenyl group, a 2-methyl-4-cyanophenyl group, a 2-methyl-4-nitrophenyl group or a dodecylphenyl group, etc.), a hydroxyl group, a sulfonamino group, an alkoxy group (for example, a methoxy group, an isopropoxy group, a t-butoxy group or a cyclohexyloxy group, etc.), an aryloxy group (for example, a phenoxy group, a 4-methylphenoxy group, a 3-methoxyphenoxy group or a 3,5-dimethylphenoxy group, etc.), an alkylthio group (for example, a methylthio group, an ethylthio group or an octylthio group, etc.), an arylthio group (for example, a phenylthio group or a 4-methylphenylthio group, etc.), an acyl group (for example, an acetyl group, etc.), an acylamino group (for example, an acetylamino group, etc.), an alkylamino group (for example, a methylamino group, etc.), a nitro group or a cyano group, etc. (for example, a $\beta$-hydroxyethyl group, a 2-chloroethyl group, a 2-bromoethyl group, a benzyl group, a p-dodecylphenylmethyl group, a 3-(perfluorooctadecanesulfonamido)propyl group or a methoxyethyl group, etc.).

$R_1$, $R_2$, $R_3$ and $R_4$ each may represent an alkenyl group (for example, a vinyl group, an allyl group or a 5-octenyl group, etc.), an aryl group or a substituted aryl group [where substituents for the substituted aryl group includes, for example, an alkyl group (e.g., methyl, ethyl, etc.), an alkoxy group (e.g., methoxy, ethoxy, etc.), a halogen atom (e.g., chlorine, bromine, etc.), a hydroxyl group and a nitro group, etc.]. Examples of these groups include a phenyl group, a 4-methylphenyl group, a 4-chlorophenyl group, a 2-methoxyphenyl group, a 3-hydroxy-2-methylphenyl group and a 3-methyl-4-nitrophenyl group, etc.

$X^{\ominus}$ represents an anion. Examples of suitable anions include a fluoride ion, a chloride ion, a bromide ion, and iodide ion, a perchlorate ion, a p-toluene-sulfonate ion, a tetrafluoroborate ion, a methanesulfonate ion and a tetrahydroborate ion, etc.

Further, it is preferred for the sum of the number of carbon atoms in $R_1$ to $R_4$ be 40 or less.

Examples of compounds represented by the general formula (I) which can be used in the present invention are described below.

(1) Tetramethylammonium chloride
(2) Tetramethylammonium bromide
(3) Tetramethylammonium iodide
(4) Tetramethylammonium hydrogen sulfate
(5) Tetramethylammonium perchlorate
(6) Tetramethylammonium tetrafluoroborate
(7) Tetramethylammonium p-toluenesulfonate
(8) Tetraethylammonium borohalide
(9) Tetraethylammonium chloride
(10) Tetraethylammonium bromide
(11) Tetraethylammonium iodide
(12) Tetraethylammonium fluoride
(13) Tetra-n-propylammonium bromide
(14) Tetra-n-propylammonium iodide
(15) Tetra-n-butylammonium chloride
(16) Tetra-n-butylammonium bromide
(17) Tetra-n-butylammonium hydrogen sulfate
(18) Tetra-n-butylammonium iodide
(19) Tetra-n-butylammonium perchlorate
(20) Benzyldimethyllaurylammonium chloride
(21) Benzyldimethylphenylammonium chloride
(22) Benzyldimethyltetradecylammonium chloride
(23) Benzyltriethylammonium chloride

(24) Benzyltriethylammonium bromide
(25) Benzyltriethylammonium iodide
(26) Benzyltrimethylammonium chloride
(27) Benzyltrimethylammonium bromide
(28) β-Bromoethyltrimethylammonium bromide
(29) Phenyltriethylammonium chloride
(30) Phenyltriethylammonium iodide
(31) Phenyltrimethylammonium chloride
(32) Phenyltrimethylammonium bromide
(33) Phenyltrimethylammonium iodide
(34) Trimethylstearylammonium chloride
(35) Trimethylvinylammonium bromide
(36) Tri-n-propylethylammonium iodide
(37) Cetylbenzyldimethylammonium chloride
(38) Cetyldimethylethylammonium bromide
(39) Cetyltrimethylammonium chloride
(40) Cetyltrimethylammonium bromide
(41) Dodecylbenzyltrimethylammonium hexafluorophosphate
(42) Trimethyl-3-(perfluorooctadecanesulfonamido)-propylammonium iodide
(43) Tetramethylammonium methanesulfonate
(44) n-Decyltrimethylammonium chloride
(45) Dodecyltrimethylammonium chloride
(46) N,N'-pentamethylenebis(tributylammonium bromide)
(47) bis[2-(N,N,N-Triethylammonium)ethyl]sulfone bromide Compounds represented by formula (I) can be used in this invention are known, and are described in, e.g., W. P. Weber et al, *Phase Transfer Catalysis in Organic Synthesis,* Springer-Verlag (1977) and C. M. Starks et al, *Phase Transfer Catalysis Principles and Techniques,* Academic Press (1978), etc. Compounds which are not specifically described in these documents can be synthesized by analogy to the processes described therein.

The amount of the compounds represented by the general formula (I) in the alkaline processing composition element in the present invention preferably is in the range of about $10^{-6}$ to 1.0 g per kg of the alkaline processing composition. A more preferred amount is $10^{-4}$ to 1.0 g, most preferably $10^{-2}$ to 0.8 g, per kg of the alkaline processing composition. It is believed that the compounds of formula (I) would not interact with dye releasing redox compounds and hence would not form salts thereof, contrary to the teaching of U.S. Pat. No. 3,161,508, due to the use of the compounds of formula (I) in a very small amount.

The developing agent cadpable of causing cross-oxidation of the above-described dye releasing redox compound in the present invention has a one-electron oxidation-reduction potential of −80 mV to −200 mV with respect to a saturated calomel electrode at a pH of 11.0.

In the present invention, any developing agent capable of causing cross-oxidation of the dye releasing redox compounds may be used if it has the above-described oxidation-reduction potential. Examples of developing agents which can be used include 1-phenyl-3-pyrazolidinones and aminophenols.

Preferred developing agents having the above-described oxidation-reduction potential are compounds represented by the following general formulas (II) and (III), which have a one-electron oxidation-reduction potential of −80 mV to −20 mV with respect to a saturated calomel electrode at a pH of 11.0.

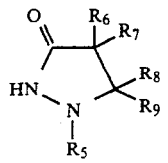

(II)

In the formula (II), $R_5$ represents an aryl group or a substituted aryl group [where substituents for the substituted aryl group include, for example, an alkyl group (e.g., methyl, ethyl, etc.), an alkoxy group (e.g., methoxy, ethoxy, etc.), a halogen atom (e.g., chlorine, bromine, etc.) and an acylamino group (e.g., acetylamino, etc.), etc.] (for example, a phenyl group, a 4-methylphenyl group, a 4-methoxyphenyl group, a 4-chlorophenyl group, a 3-methylphenyl group, a 2-methoxyphenyl group or a 3,5-dimethylphenyl group, etc.).

$R_6$, $R_7$, $R_8$ and $R_9$, which may be the same or different, each represents a hydrogen atom, an alkyl group or a substituted alkyl group. Examples of suitable alkyl groups include a methyl group, an ethyl group, an isopropyl group, a t-butyl group and a cyclohexyl group, etc., which may be substituted by one or more substituents such as a hydroxyl group, an acyloxy group (for example, an acetyloxy group, etc.), a tetrahydropyran-2-yloxy group, an aryl group (for example, a phenyl group, etc.), an alkoxy group (for example, a methoxy group, an ethoxy group, etc.), an aryloxy group (for example, a phenoxy group, etc.), an alkylthio group (for example, a methylthio group, etc.), an arylthio group (for example, a phenylthio group, etc.), an alkylamino group (for example, a methylamino group, etc.), a nitro group, a cyano group, an amino group or a halogen atom, etc. (for example, a hydroxymethyl group, an acetyloxymethyl group, a tetrahydropyran-2-yloxymethyl group, a t-butoxymethyl group, a hydroxyethyl group or a benzyl group, etc.). $R_6$, $R_7$, $R_8$ and $R_9$ each may represent an aryl group or a substituted aryl group [where substituents for the substituted aryl group include, for example, an alkyl group (e.g., methyl, ethyl, etc.), an alkoxy group (e.g., methoxy, etc.), a halogen atom (e.g., chlorine, bromine, etc.), a hydroxyl group and a nitro group, etc.] (for example, a phenyl group, a 4-methylphenyl group, a 3-methoxyphenyl group, a 2-hydroxyphenyl group, a 3-methyl-4-nitrophenyl group, a 4-chlorophenyl group or a naphthyl group, etc.), an alkoxy group (for example, a methoxy group, an isopropoxy group, a t-butoxy group or a cyclohexyloxy group, etc.), an aryloxy group (for example, a phenoxy group or a 4-methylphenoxy group, etc.), a benzyloxy group, an alkoxycarbonyl group (for example, a methoxycarbonyl group or an ethoxycarbonyl group, etc.) or a carboxyl group.

Preferred examples and values of the one-electron oxidation-reduction potential thereof are described in Table 1 below.

TABLE 1

| Compound Represented by the General Formula (II) | pH: 11.0 mV (vs S.C.E.) |
|---|---|
| 1-Phenyl-3-pyrazolidinone | −100 |
| 4,4-Dimethyl-1-phenyl-3-pyrazolidinone | −100 |
| 4-Hydroxymethyl-4-methyl-1-phenyl-3-pyrazolidinone | −102 |
| 4-Hydroxymethyl-4-methyl-1-p-tolyl-3-pyrazolidinone | −142 |

TABLE 1-continued

| Compound Represented by the General Formula (II) | pH: 11.0 mV (vs S.C.E.) |
|---|---|
| 4-Hydroxymethyl-4-methyl-1-(4-methoxyphenyl)-3-pyrazolidinone | −182 |
| 4,4-bis(Hydroxymethyl)-1-phenyl-3-pyrazolidinone | −110 |
| 4,4-bis(Hydroxymethyl)-1-p-tolyl-3-pyrazolidinone | −140 |

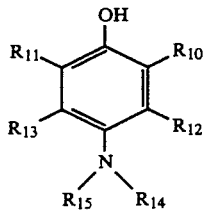

(III)

In the formula, $R_{10}$, $R_{11}$, $R_{12}$ and $R_{13}$, which may be the same or different, each represents a hydrogen atom, a halogen atom (for example, a chlorine atom or a bromine atom, etc.), an alkyl group (for example, a methyl group, an ethyl group, an isopropyl group, a tertbutyl group or a cyclohexyl group, etc.), a substituted or unsubstituted aryl group (for example, a phenyl group, a p-methoxyphenyl group, a p-methylphenyl group, a 2-methyl-4-nitrophenyl group, a 3,5-dimethylphenyl group or a 4-chlorophenyl group, etc.), an alkoxy group (for example, a methoxy group or an ethoxy group, etc.), or a substituted or unsubstituted phenoxy group (for example, a phenoxy group, a p-methylphenoxy group or a 2-methoxy-4-chlorophenoxy group, etc.). $R_{14}$ and $R_{15}$, which may be the same or different, each represents a hydrogen atom or an alkyl group (for example, a methyl group, an ethyl group, an isopropyl group, a tert-butyl group or a cyclohexyl group, etc.). This alkyl group may be substituted with one or more substituents such as a halogen atom, an aryl group (for example, a phenyl group, etc.), a hydroxyl group, an alkoxy group (for example, a methoxy group, an ethoxy group, etc.), an aryloxy group (for example, a phenoxy group, etc.), an alkylthio group (for example, a methylthio group, etc.), an arylthio group (for example, a phenylthio group, etc.), an amino group, an acylamino group (for example, an acetylamino group, a pivaloylamino group, etc.), an alkylamino group (for example, a methylamino group, a dimethylamino group, etc.), a sulfonamido group, a cyano group, a nitro group, a sulfo group, a tetrahydropyran-2-yloxy group, an acyloxy group (for example, an acetyloxy group, etc.), an acyl group (for example, an acetyl group, etc.), or a 5- or 6-membered heterocyclic group having N, O and S as a hetero atom (for example, a tetrahydropyran-2-yl group, a furan-2-yl group, a pyridyl group, etc.), etc. (for example, a hydroxyethyl group, an ethoxyethyl group, a 4-sulfobutyl group, a tetrahydropyran-2-ylmethyl group, a methanesulfonamidoethyl group, an acetyloxyethyl group, a benzyl group or an acylaminoethyl group, etc.). Further, $R_{14}$ and $R_{15}$ each represents a substituted or unsubstituted aryl group [where substituents for the substituted aryl group include, for example, an alkyl group (e.g., methyl, ethyl, etc.); an alkoxy group (e.g., methoxy, etc.), a halogen atom (e.g., chlorine, bromine, etc.) and a nitro group, etc.] (for example, a phenyl group, a p-methoxyphenyl group, a 2,4-dimethylphenyl group, a p-nitrophenyl group or a 2-methyl-4-chlorophenyl group, etc.), an acyl group (for example, an acetyl group, etc.), an alkoxycarbonyl group (for example, a methoxycarbonyl group, etc.), an alkylsulfonyl group (for example, a methylsulfonyl group, etc.), or an arylsulfonyl group (for example, a phenylsulfonyl group, etc.). $R_{14}$ and $R_{15}$ may form a ring, for example, a trimethylene group or a propenylene group, by ring closure. Further, $R_{14}$ and $R_{15}$ may combine and form a nitrogen containing 5- or 6-membered heterocyclic ring (for example, a pyrrolidine ring, a piperidine ring or a succinic acid imide ring, etc.). $R_{10}$ and $R_{12}$ may combine and form a 6-membered hydrocarbon ring (for example, a benzene ring or a cyclohexane ring).

Preferred examples and values of the one-electron oxidation-reduction potential are shown in Table 2 below.

TABLE 2

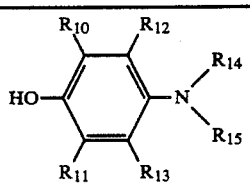

| $R_{10}$ | $R_{11}$ | $R_{12}$ | $R_{13}$ | $R_{14}$ | $R_{15}$ | pH: 11.0 mV (vs S.C.E.) |
|---|---|---|---|---|---|---|
| H | H | H | H | $C_2H_5$ | $C_2H_5$ | −81 |
| H | H | H | H | $C_2H_5$ | $C_3H_7$ | −85 |
| $C_6H_5$ | H | H | H | $C_2H_5$ | $C_2H_5$ | −110 |
| Cl | H | H | H | $(CH_2)_4$ | | −110 |
| H | H | H | H | $(CH_2)_4$ | | −130 |
| $CH_3$ | H | H | H | $CH_3$ | $CH_3$ | −146 |
| $CH_3$ | $CH_3$ | H | H | $CH_3$ | $CH_3$ | −178 |
| H | H | H | $(CH_2)_3$ | | $C_2H_5$ | −190 |

The developing agent is present in the alkaline processing composition element in an amount of 0.5 g to 50 g per kg of the alkaline processing composition.

A processing composition composing the processing composition element used in the present invention is a liquid composition which contains the processing components necessary to develop silver halide emulsions and to form diffusion transfer dye images or residual dye images after diffusion of released dyes, wherein the main component of the solvent is water and the solvent may contain other water-miscible solvents such as methanol or 2-methoxyethanol. The processing composition contains an alkali in an amount necessary to maintain the pH at a value required for development of the emulsion layers and to neutralize acids (for example, hydrohalic acid such as hydrobromic acid, etc.) formed in the steps of development or dye image formation.

As alkaline substances in the alkaline processing composition used in the present invention, alkali metal hydroxides such as sodium hydroxide, potassium hydroxide, rubidium hydroxide or cesium hydroxide, etc., are mainly used.

Further, sodium carbonate and amines such as diethylamine may be used as alkalis. It is preferred that the alkali substances are contained in the alkaline processing compositions so that the pH thereof is about 11 or more.

The alkaline processing composition used in the present invention preferably contains a viscosity increasing compound. Suitable viscosity increasing compounds which can be used are, for example, ethers which are inert to alkaline solutions, such as alkali metal salts of hydroxyethyl cellulose or carboxymethyl cellulose (for example, sodium carboxymethyl cellulose). The amount thereof advantageously is in the range of about 1 to 10% by weight based on the weight of the processing solution. The viscosity preferably is in the range of about 100 to 200,000 cps. Accordingly, it is possible to use polysaccharide gums such as guar gums described in *Research Disclosure*, No. 15162 (Nov. 1976), xanthans or algins as a viscosity increasing compound in addition to the above-described viscosity increasing compound.

The alkaline processing composition used in the present invention preferably contains an opacifying agent as described below. For example, carbon black, titanium dioxide and light absorptive dyes, for example, indicator dyes, etc., can be used. As the indicator dye, dyes which are transparent at the time of exposure and become colored or opaque when contacted with the alkali in the processing composition are preferred.

Further, the photographic element of the present invention can contain various compounds as described below depending on the purpose, but it is preferred to add them to the alkaline processing solution.

The photographic element of the present invention can contain the following additives for the purpose of increasing transfer image densities. For example, aromatic alcohols such as benzyl alcohol or p-xylene-$\alpha,\alpha'$-diol, etc., as described in U.S. Pat. No. 3,846,129 can be used.

Moreover, aliphatic and alicyclic glycols and saturated aliphatic and alicyclic aminoalcohols described in U.S. Pat. No. 4,030,920, such as 1,4-cyclohexane dimethanol, 1,6-hexanediol, 3-amino-1-propanol, 2-amino-1-propanol, 5-amino-1-pentanol, 6-amino-1-hexanol and 2-amino-2-methyl-1-propanol, etc., can be employed.

Other compounds for increasing $D_{max}$ include colloidal silica and potassium iodide, as described in *Research Disclosure*, No. 15162 (Nov. 1976).

The photographic element of the present invention may contain the following compounds described in U.S. Pat. No. 3,942,987 in order to prevent pimple-like deformations caused after substantial conclusion of the development. For example, alkali metal fluorides and oxalates and barium salts, etc., can be used.

In the photographic element of the present invention, it is possible to control gradation by using a competitive developing agent as described in, for example, *Research Disclosure*, No. 15162 (Nov. 1976) in combination. For example, hydroquinone, methylhydroquinone and t-butylhydroquinone, etc., can be used.

The photographic element of the present invention may contain compounds as described in U.S. Pat. No. 2,497,917. For example, 5-methylbenzotriazole, 5,6-dichlorobenzotriazole, 6-nitrobenzimidazole and histidine, etc., are suitable.

In the alkaline processing composition used in the present invention, pigments such as carbon black or titanium dioxide are often dispersed uniformly. In this case, known dispersing assistants or surface active agents may be used. For example, alkali metal salts of polyacrylic acid, naphthalenesulfonic acid, condensation products of naphthalenesulfonic acid and formaldehyde, and polystyrenesulfonic acid, etc., can be employed.

The above-described compounds used as the competitive developing agents in the present invention have an excellent gradation-controlling function so that gradation of the toe part of the characteristic curve becomes high, as compared with that obtained using known hydroquinone, methylhydroquinone and t-butylhydroquinone. An improvement in color reproduction is observed as an improvement in the gradation of the toe part.

The dye releasing redox compounds used in the present invention can be represented by the following formula (IV).

$$Y—D \qquad (IV)$$

In the formula, Y represents a group which has the function of releasing a diffusible dye D (or a precursor thereof) on splitting of the dye releasing redox compound as a result of the reaction, which is called a "redox center". Y generally contains a "ballast group" for making the dye releasing redox compound non-diffusible. D may represent a dye itself or may contain a bonding group for linking the dye to Y.

Examples of preferred dyes which can be used in the present invention include azo dyes, azomethine dyes, anthraquinone dyes, phthalocyanine dyes, indigoid dyes, triphenylmethane dyes, metal complex dyes and colored metal complexes.

Examples of Y groups which can be effectively used include N-substituted sulfamoyl groups. For example, a group represented by the following formula (A) can be used as Y.

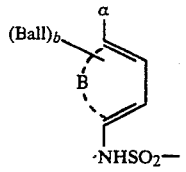

(A)

In the formula, $\beta$ represents a non-metal atomic group necessary to form a benzene ring which may be condensed with a carbocyclic or a heterocyclic ring to form, for example, a naphthalene ring, a quinoline ring, a 5,6,7,8-tetrahydronaphthalene ring or a chroman ring, etc. Further, the above-described benzene ring or ring formed by condensing the benzene ring with a carbocyclic or heterocyclic ring may be substituted with one or more of a halogen atom (for example, a chlorine atom, a bromine atom), an alkyl group (for example, a methyl group, an ethyl group, etc.), an alkoxy group (for example, a methoxy group, an ethoxy group, etc.), an aryl group (for example, a phenyl group, etc.), an aryloxy group (for example, a phenoxy group, etc.), a nitro group, an amino group, an alkylamino group (for example, a methylamino group, an ethylamino group, etc.), an arylamino group (for example, a phenylamino group, etc.), an amido group, a cyano group, an alkylthio group (for example, a methylthio group, etc.), a keto group, an alkoxycarbonyl group and a heterocyclic group, etc.

$\alpha$ represents a group represented by the formula $—OG^1$ or $—NHG^2$. $G^1$ represents a hydrogen atom or a group which forms a hydroxyl group by hydrolysis and it represents preferably a hydrogen atom or a group represented by the formula $$—\overset{O}{\overset{\|}{C}}G^3 \text{ or } —\overset{O}{\overset{\|}{C}}—O—G^3$$

where $G^3$ represents an alkyl group, particularly, an alkyl group having 1 to 18 carbon atoms such as a methyl group, an ethyl group or a propyl group, etc., a halogen-substituted alkyl group having 1 to 18 carbon atoms such as a chloromethyl group or a trifluoromethyl group, etc., a phenyl group or a substituted-phenyl group. Further, $G^2$ represents a hydrogen atom, an alkyl group having 1 to 22 carbon atoms or a hydrolyzable group. A preferred hydrolyzable group represented by $G^2$ is a group represented by the formula $$-\overset{\overset{\displaystyle O}{\|}}{C}G^4,$$

$-SO_2G^5$ or $-SOG^5$, where $G^4$ represents an alkyl group having 1 to 4 carbon atoms (such as methyl group); a halogen-substituted alkyl group (such as a mono-, di- or trichloromethyl group or a trifluoromethyl group); an alkylcarbonyl group (such as an acetyl group); an alkoxy group (such as a methoxy group, an ethoxy group, a propoxy group, a butoxy group, etc.); a substituted phenyl group (such as a nitrophenyl group or a cyanophenyl group); a phenoxy group which may be substituted by a lower alkyl group (such as a methyl group, an ethyl group, etc.) or a halogen atom; a carboxyl group; an alkyloxycarbonyl group (such as a methoxycarbonyl group, an ethoxycarbonyl group, etc.); an aryloxycarbonyl group (such as a phenylcarbonyl group, a p-methoxyphenylcarbonyl group, etc.); an alkylsulfonylethoxy group (such as a methylsulfonylethoxy group, an ethylsulfonylethoxy group, etc.); or an arylsulfonylethoxy group (such as a phenylsulfonylethoxy group, etc.); and $G^5$ represents a substituted or unsubstituted alkyl group (such as a methyl group, an ethyl group, etc.) or aryl group (such as a phenyl group, a p-tolyl group, etc.).

Further, b is 0 or an integer of 1 or 2. But b is 1 or 2 and preferably 1, except where an alkyl group which make the compound represented by the general formula (A) immovable or non-diffusible is introduced as $G^2$ in $-NHG^2$ in $\alpha$, namely, where $\alpha$ is a group represented by $-OG^1$ or a group represented by $-NHG^2$ where $G^2$ is a hydrogen atom, an alkyl group having 1 to 8 carbon atoms or a hydrolyzable group.

Ball represents a ballast group. Suitable ballast groups are illustrated below.

Examples of this kind of Y and dye releasing redox compounds are described in Japanese Patent Application (OPI) Nos. 143230/79 and 50736/78 (the term "OPI" as used herein refers to a "published unexamined Japanese patent application") and U.S. Pat. Nos. 3,928,312, 3,933,638, 4,076,529, 4,152,153 and 4,135,929.

Another example of Y suitable for this type of compound is the group represented by the following formula (B).

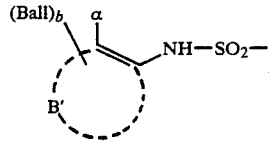

(B)

In the formula, Ball, $\alpha$ and b have the same meaning as in the formula (A), and $\beta'$ represents an atomic group necessary to form a carbocyclic ring, for example, a benzene ring which may condense with a carbocyclic or heterocyclic ring to form a naphthalene ring, a quinoline ring, a 5,6,7,8-tetrahydronaphthalene ring or a chroman ring, etc. Further, the above-described various rings may be substituted with one or more of a halogen atom, an alkyl group, an alkoxy group, an aryl group, an aryloxy group, a nitro group, an amino group, an alkylamino group, an arylamino group, an amido group, a cyano group, an alkylthio group, a keto group, a carboalkoxy group and a heterocyclic group, etc. Examples of this kind of Y and dye releasing redox compound are described in U.S. patent application Ser. No. 170,261 (filed July 18, 1980), Japanese Patent Application (OPI) Nos. 149328/78, 65034/79 and 111344/79 and U.S. Pat. Nos. 4,053,312 and 4,055,428.

As Y and dye releasing redox compounds other than as above described, it is possible to use those described in Japanese Patent Application (OPI) No. 46730/78 and U.S. Pat. Nos. 3,443,943, 4,198,235, 4,149,892, 3,844,785, 3,443,939, 3,628,952, 4,142,891, 4,199,354, 4,199,355 and 3,980,479.

A ballast group is an organic ballast group by which the dye releasing redox compound is rendered nondiffusible during development in the alkaline processing solution, and is preferably a group containing a hydrophobic group having 8 to 32 carbon atoms. The organic ballast group is bonded to the dye releasing redox compound directly or through a bonding group (for example, an imino bond, an ether bond, a thioether bond, a carbonamido bond, a sulfonamido bond, a ureido bond, an ester bond, an imido bond, a carbamoyl bond or a sulfamoyl bond or a combination thereof).

Suitable ballast groups are described in the above-described patent specifications (for example, in U.S. Pat. Nos. 3,928,312, 3,993,638, 4,076,529, 4,152,153 and 4,135,929, etc.) concerning examples of "Y and dye releasing redox compound", and are well known to those skilled in the art.

The amount of the dye releasing redox compounds to be coated is about $1\times10^{-4}$ to about $1\times10^{-2}$ mol/m$^2$, preferably $2\times10^{-4}$ to $2\times10^{-3}$ mol/m$^2$.

The dye releasing redox compounds used in the present invention can be dispersed in hydrophilic colloids as carriers using various methods depending on the type of compound. For example, a compound having a dissociative groups, such as a sulfo group or a carboxyl group, can be added to a hydrophilic colloid solution after dissolving such in water or an aqueous alkaline solution. A dye releasing redox compound which is easily soluble in organic solvents is dissolved in an organic solvent and the resulting solution is then added to a hydrophilic colloid solution and finely dispersed by stirring. Suitable solvents are ethyl acetate, tetrahydrofuran, methyl ethyl ketone, cyclohexanone, $\beta$-butoxy-$\beta$-ethoxyethyl acetate, dimethylformamide, dimethyl sulfoxide, 2-methoxyethanol and tri-n-butyl phthalate, etc. Of these solvents for dispersing, those having a relatively low vapor pressure can be volatilized on drying the photographic layer or can be volatilized by a method described in U.S. Pat. Nos. 2,322,027 and 2,801,171. Of these solvents for dispersing, those which are soluble in water can be removed by a method of washing with water as described in U.S. Pat. Nos. 2,949,360 and 3,396,027. In order to stabilize the dispersion of the dye releasing redox compound and to accelerate dye image formation, it is advantageous to incorporate a solvent which is substantially insoluble in water and has a boiling point of 200° C. or more at normal pressure in the photographic element together with the dye releasing redox compound. Solvents having a high boiling point suitable for this purpose are aliphatic esters such as higher aliphatic acid triglycerides or dioctyl adipate, phthalic acid esters such as di-n-butyl phthalate, phosphoric acid esters such as tri-o-cresyl phosphate or tri-n-hexyl phosphate, amides such as N,N-diethyl laurylamide and hydroxy compounds such as 2,4-di-n-amylphenol. Further, in order to stabilize the dispersion of the dye releasing redox compound and to accelerate dye image formation, it is advantageous to incorporate a solvent-philic polymer in the photographic element together with the dye releasing redox compound. Solvent-philic solvents suitable for this purpose are shellac; phenol-formaldehyde condensation products; poly-n-butyl acrylate; n-butyl acrylate-acrylic acid copolymers; and n-butyl acrylate-styrene-methacrylamide copolymers, etc. These polymers may be dispersed in the hydrophilic colloid after dissolving in an organic solvent together with the dye releasing redox compound, or a hydrosol of the polymer prepared by emulsion polymerization, etc., may be added to a hydrophilic colloid dispersion of the dye releasing redox compound. Dispersion of the dye releasing redox compound can be effectively attained in general under a large shearing force. The dispersion of the dye releasing redox compounds can be remarkably promoted using surface active agents as emulsifying assistants. Surface active agents useful for dispersing the dye releasing redox compounds used in the present invention are sodium triisopropylnaphthalene sulfonate, sodium dinonylnaphthalene sulfonate, sodium p-dodecylbenzenesulfonate, sodium dioctylsulfosuccinate, sodium cetyl sulfate and anionic surface active agents as described in Japanese Patent Publication No. 4393/64. When these anionic surface active agents are used together with higher aliphatic acid esters of anhydrohexitol, a particularly excellent emulsifying ability is exhibited as disclosed in U.S. Pat. No. 3,676,141.

Hydrophilic colloids which can be used for dispersing the dye releasing redox compounds used in the present invention are, for example, gelatin, colloidal albumin, casein, cellulose derivatives such as carboxymethyl cellulose or hydroxyethyl cellulose, etc., saccharide derivatives such as agar, sodium alginate or starch derivatives, etc., and synthetic hydrophilic colloids such as polyvinyl alcohol, poly-N-vinylpyrrolidone, acrylic acid copolymers, polyacrylamide and derivatives thereof (for example, partially hydrolyzed products thereof), etc. If desired, a compatible mixture of two or more of these colloids can be used. Of them, gelatin is most generally used, but a part or all of the gelatin may be replaced by synthetic hydrophilic colloids.

The silver halide emulsions used in the present invention are hydrophilic colloid dispersions of silver chloride, silver bromide, silver chlorobromide, silver iodobromide, silver chloroiodobromide or a mixture thereof, the halogen composition of which can be suitably selected depending on the purpose of use of the photosensitive material. However, it is particularly preferred to use silver bromide, silver iodobromide and silver chloroiodobromide having an iodide content of 10% by mol or less and a chloride content of 30% by mol or less.

Internal latent image type silver halide emulsions which can be advantageously used in the present invention are described in U.S. Pat. Nos. 2,592,250, 3,206,313, 3,447,927, 3,761,276 and 3,935,014, etc.

Nucleus forming agents for this type of emulsion include hydrazines as described in U.S. Pat. Nos. 2,588,982 and 2,563,785, hydrazides and hydrazones as described in U.S. Pat. No. 3,227,552, and quaternary salt compounds as described in British Patent No. 1,283,835, Japanese Patent Publication No. 38164/74 and U.S. Pat. Nos. 3,734,738, 3,719,494 and 3,615,615.

The silver halide emulsions used in the present invention may have an enhanced color sensitivity obtained, if desired, using spectrally sensitizing dyes.

It is indispensable for the dye image receiving element to have a mordant layer comprising a poly-4-vinylpyridine latex (particularly, in polyvinyl alcohol) as described in U.S. Pat. No. 3,148,061, polyvinylpyrrolidone as described in U.S. Pat. No. 3,003,872 or polymers containing quaternary ammonium salts, as described in U.S. Pat. No. 3,239,337 as a mordant. Other mordants which can be used are basic polymers as described in U.S. Pat. Nos. 2,882,156, 3,625,694 and 3,709,690, etc. In addition, the mordants as described in U.S. Pat. Nos. 2,484,430, 3,271,147, 3,184,309 and 3,271,147, etc., can be effectively used.

In the photosensitive elements capable of employing the present invention, silver halide emulsions and dye image providing materials are combined. Combinations of the color sensitivity of the silver halide emulsion and spectral absorption of the dye image are appropriately selected depending on the desired color reproduction. For reproduction of natural color by a subtractive process, a photosensitive element comprising at least two combinations composed each of an emulsion having a selective spectral sensitivity to a certain wavelength range and a compound providing a dye image having a selective spectral absorption in the same wavelength range is used. Particularly, a photosensitive element comprising a combination of a blue-sensitive silver halide emulsion and a yellow dye releasing redox compound, a combination of a green-sensitive silver halide emulsion and a magenta dye releasing redox compound and a combination of a red-sensitive silver halide emulsion and a cyan dye releasing redox compound is useful. In order to prevent undesirable interaction between the silver halide emulsion units having each a different spectral sensitivity, an intermediate layer can be provided between the emulsions.

These combination units composed of the emulsions and the dye releasing redox compounds may be coated by superposing in a face-to-face relation in the photosensitive element or may be applied as a mixture of particles (wherein a dye releasing redox compound and silver halide are present in the same particle) to form one layer.

A separating layer as described in U.S. patent application Ser. No. 83,706 (filed Oct. 11, 1979) may be provided between the intermediate layer and the layer containing the dye image providing material. A silver halide emulsion may be added to the intermediate layer as described in U.S. patent application Ser. No. 204,667 (filed Nov. 6, 1980).

As a neutralization layer, a neutralization rate controlling layer (timing layer) and a processing composition, etc., capable of use in the color diffusion transfer photosensitive material of the present invention as described in, for example, Japanese patent application (OPI) No. 64533/77 can be utilized.

It is preferred for the color diffusion transfer photosensitive element of the present invention to be a monosheet type film unit (a combination of a photosensitive element, an image receiving element and a processing element) which is always unified before, during and after exposure and are capable of development in the light. Such film units are described in *Photographic Science and Engineering* and *Neblette's Handbook of Photography and Reprography Materials, Process and Systems,* Seventh Ed. (1977), Chapter 12, etc.

The process for obtaining color diffusion transfer images using dye releasing redox compounds is described in *Photographic Science and Engineering,* Vol. 20, No. 4, pages 155–164, July/August 1976.

The advantage of the present invention is that a color diffusion transfer photographic element which rapidly form images having a high image density using the silver halide developing agent having a low oxidation-reduction potential is provided.

Compounds represented by the general formula (I) used in the present invention are capable of increasing dye densities without any substantial increase in silver development. This function is clearly different from the function of prior quaternary salt compounds known as development accelerators, which is unexpected.

The following examples are given to illustrate the present invention in greater detail. Unless otherwise indicated, all parts, percents, ratios and the like are by weight.

EXAMPLE 1

To a transparent polyethylene terephthalate film support, the following layers were applied in the order described to produce a photosensitive element.

(1) An image receiving layer containing 4.0 g/m$^2$ of copoly(styrene-N-vinylbenzyl-N,N,N-trihexyl ammonium chloride) and 4.0 g/m$^2$ of gelatin.

(2) A white reflection layer containing 22 g/m$^2$ of titanium dioxide and 2.2 g/m$^2$ of gelatin.

(3) An opaque layer containing 2.7 g/m$^2$ of carbon black and 2.7 g/m$^2$ of gelatin.

(4) A layer containing 0.50 g/m$^2$ of a cyan dye releasing redox compound having the following structure

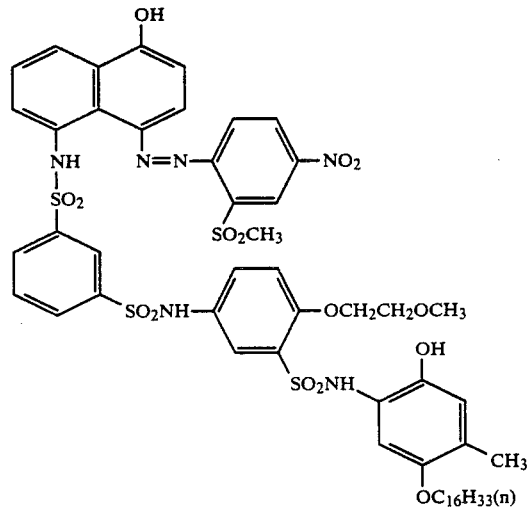

0.50 g/m$^2$ of N,N-diethyllaurylamide and 1.5 g/m$^2$ of gelatin.

(5) A layer containing a red-sensitive internal latent image type emulsion (gelatin: 1.1 g/m$^2$, silver: 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(6) A stain preventing layer containing gelatin (1.0 g/m$^2$), 2,5-di-t-pentadecylhydroquinone (1.0 g/m$^2$) and tricresyl phosphate (0.5 g/m$^2$).

(7) A layer containing a magenta dye releasing redox compound having the following structure (0.80 g/m$^2$)

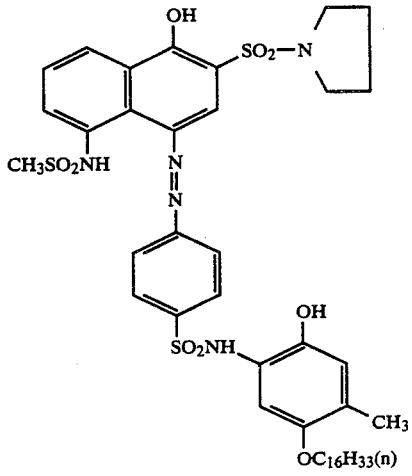

N,N-diethyllaurylamide (0.20 g/m$^2$) and gelatin (1.2 g/m$^2$).

(8) A layer containing a green-sensitive internal latent image type silver bromide emulsion (gelatin: 1.1 g/m$^2$, silver: 1.4 g/m$^2$), -acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(9) A stain preventing layer containing gelatin (1.0 g/m$^2$), 2,5-di-t-pentadecylhydroquinone (1.0 g/m$^2$) and tricresyl phosphate (0.5 g/m$^2$).

(10) A layer containing a yellow dye releasing redox compound having the following structure (1.0 g/m$^2$)

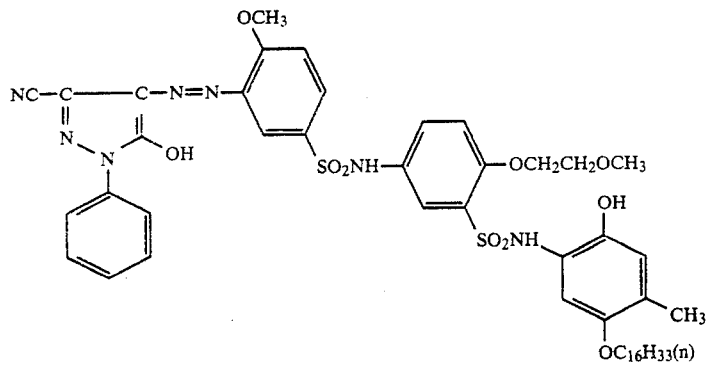

N,N-diethyllaurylamide (0.25 g/m$^2$) and gelatin (1.0 g/m$^2$).

(11) A layer containing a blue-sensitive internal latent image type silver bromide emulsion (gelatin: 1.1 g/m$^2$, silver: 1.4 g/m$^2$), 1-acetyl-2-[4-(2,4-di-t-pentylphenoxyacetamido)phenyl]hydrazine (10.015 g/m$^2$) and sodium 2-pentadecylhydroquinone-5-sulfonate (0.067 g/m$^2$).

(12) A protective layer containing 1.3 g/m$^2$ of gelatin, 0.9 g/m$^2$ of polyethylacrylate latex, 0.5 g/m$^2$ of Tinuvin and 0.026 g/m$^2$ of triacryloyl perhydrotriazine, as a hardening agent.

The above-described coating film was imagewise exposed to light through a continuous wedge using a tungsten light of 2,854° K. which was converted into light of 4,800° K. by passage through a Davis-Gibson filter. (The maximum exposure in this case was 10 C.M.S.) The exposed film was developed using the following processing solution.

Processing Composition A (Control)

| | |
|---|---|
| Potassium Hydroxide | 56 g |
| 4-Hydroxymethyl-4-methyl-1-tolyl-3-pyrazolidinone | 5.3 g |
| 5-Methylbenzotriazole | 3.5 g |
| 2-Methyl-5-isopropylhydroquinone | 0.3 g |
| Sodium Sulfite | 0.2 g |
| Benzyl Alcohol | 1.5 ml |
| Carboxymethyl Cellulose | 5.8 g |
| Carbon Black | 150 g |
| Water to make | 1 l |

Processing Composition B

Prepared by adding 10 ml of a 1% by weight aqueous solution of Compound 1 to the same composition as Processing Composition A.

Processing Composition C

Prepared by adding 10 ml of a 1% by weight aqueous solution of Compound 10 to the same composition as Processing Composition A.

Processing Composition D

Prepared by adding 30 ml of a 1% by weight aqueous solution of Compound 19 to the same composition as Processing Composition A.

Processing Composition E

Prepared by adding 10 ml of a 1% by weight aqueous solution of Compound 24 to the same composition as Processing Composition A.

Processing Composition F

Prepared by adding 30 ml of a 1% by weight aqueous solution of Compound 38 to the same composition as Processing Composition A.

Processing Composition G

Prepared by adding 10 ml of a 1% by weight aqueous solution of a compound of the formula

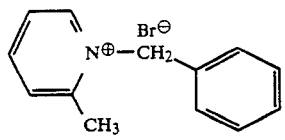

to the same composition as Processing Composition A.

The results obtained are shown in Table 3 below.

TABLE 3

| Processing Composition | $D_{max}$ Blue | Green | Red |
|---|---|---|---|
| A | 1.37 | 1.60 | 1.72 |
| B | 1.54 | 1.93 | 2.07 |
| C | 1.49 | 1.89 | 2.03 |
| D | 1.38 | 1.74 | 1.93 |
| E | 1.49 | 1.92 | 2.02 |
| F | 1.50 | 1.87 | 2.02 |
| G | 1.04 | 1.55 | 1.70 |

In all cases where the compound according to the present invention was used, increases in $D_{max}$ were observed as compared with the case of where no such compound was used.

But the quaternary ammonium salt compound useful for the system using a dye developing agent (Processing Composition G) did not exhibit the effect observed in the present invention.

EXAMPLE 2

To a transparent polyethylene terephthalate film support, the following layers were applied in the order described to produce a photosensitive element.

(1) An image receiving layer containing 4.0 g/m$^2$ of copoly(styrene-N-vinylbenzyl-N,N,N-trihexylammonium chloride) and 4.0 g/m$^2$ of gelatin.

(2) A white reflection layer containing 22 g/m$^2$ of titanium dioxide and 2.2 g/m$^2$ of gelatin.

(3) An opaque layer containing 2.7 g/m$^2$ of carbon black and 2.7 g/m$^2$ of gelatin.

(4) A layer containing 0.65 g/m² of a magenta dye releasing redox compound having the following structure

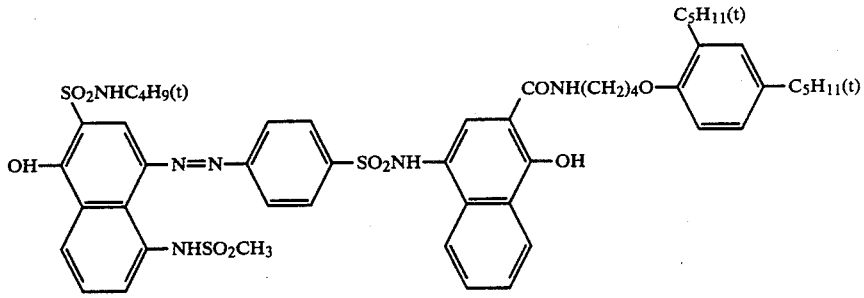

and 1.2 g/m² of gelatin.

(5) A layer containing a green-sensitive internal latent image type silver bromide emulsion (gelatin: 1.1 g/m², silver: 1.4 g/m²), 1-acetyl-2-[4-(2,4-di-t-pentylphenoxyacetamido)phenyl]hydrazine (0.015 g/m²) and sodium 2-pentadecylhydroquinone-5-sulfonate (0.067 g/m²).

(6) A stain preventing layer containing gelatin (1.0 g/m²), 2,5-di-t-pentadecylhydroquinone (1.0 g/m²) and tricresyl phosphate (0.5 g/m²).

(7) A protective layer containing 1.3 g/m² of gelatin, 0.9 g/m² of a polyethyl acrylate latex, 0.5 g/m² of Tinuvin and 0.026 g/m² of triacryloyl perhydrotriazine, as a hardening agent.

Separately, the following layers were applied to a transparent polyethylene terephthalate film support in the order described to produce a cover sheet.

(1) A neutralization layer having a thickness of 7 microns containing 17 g/m² of polyacrylic acid, 0.06 g/m² of N-hydroxysuccinimidobenzene sulfonate and 0.5 g/m² of ethylene glycol.

(2) A timing layer prepared by applying cellulose acetate (acetylation value: 54) to a thickness of 2 microns.

(3) A timing layer prepared by applying a vinylidene chloride-acrylic acid copolymer latex to a thickness of 4 microns.

The above-described coating film was exposed to light through a stepwedge with $\Delta D=0.2$ using a tungsten light of 2,854° K. which was converted into light of 4,800° K. by passage through a Davis-Gibson filter (maximum exposure in this case was 10 C.M.S.). The exposed film was developed with the following processing solution.

Processing Solutions having the same composition as Processing Solutions A–G as described in Example 1 were used.

The above-described photosensitive element and the cover sheet were faced toward each other, and the processing solution was spread at 25° C. therebetween in a liquid thickness of 80 microns.

Five minutes after spreading the processing solution, the above-described photosensitive element and the cover sheet were separated to stop the development, followed by fixing, washing with water and drying. The maximum density of the resulting sample was measured using a Densitometer FSD-103 produced by Fiji Photo Film Co. At the same time, the amount of developed silver in the maximum density area was measured using fluorescent X-rays.

These results obtained are shown in the Table 4 below.

TABLE 4

| Processing | | Amount of Developed Silver |
|---|---|---|
| Composition | $D_{max}$ | ($\mu g/cm^2$) |
| A | 1.30 | 57 |
| B | 1.57 | 57 |
| C | 1.55 | 55 |
| D | 1.43 | 55 |
| E | 1.65 | 56 |
| F | 1.62 | 58 |
| G | 1.25 | 53 |

As shown in Table 4, the same results as in Table 3 were obtained.

The amount of developed silver in this case did not substantially change as compared with the case of no addition. Accordingly, it can be seen from this result that the compound according to the present invention improves the dye releasing efficiency of the dye releasing redox compound without promoting silver development.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic element comprising (a) a photosensitive element containing at least one photosensitive silver halide emulsion layer combined with a dye releasing redox compound, (b) a dye image receiving element, and (c) an alkaline processing composition element where the alkaline processing composition element contains (1) a developing agent having a one-electron oxidation-reduction potential of −80 mV to −200 mV with respect to a saturated calomel electrode at a pH of 11.0, wherein said developing agent (1) is a 1-phenyl-3-pyrazolidone or an aminophenol, and (2) at least one of the compounds represented by the following general formula (I) in an amount of about $10^{-6}$ to 1.0 g per kg of the alkaline processing composition:

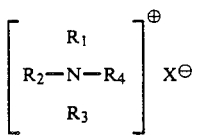

(I)

where $R_1$, $R_2$, $R_3$ and $R_4$, which may be the same or different, each represents an alkyl group, a substituted alkyl group, an alkenyl group, an aryl group or a substituted aryl group, and $X^{\ominus}$ represents an anion, wherein said element is substantially free of dye salt formation between compounds of general formula (I) and the dye releasing redox compound.

2. The color diffusion transfer photographic element of claim 1, wherein said developing agent (1) is a 1-phenyl-3-pyrazolidinone of the structural formula (II):

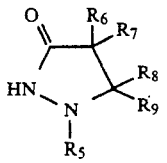

(II)

wherein $R_5$ represents an aryl group or a substituted aryl group, $R_6$, $R_7$, $R_8$ and $R_9$, which may be the same or different, each represents a hydrogen atom, an alkyl group or a substituted alkyl group.

3. The color diffusion transfer photographic element of claim 1, wherein said developing agent (1) is present in said alkaline processing composition element in an amount of 0.5 to 50 g per kg of said alkaline processing composition.

4. The color diffusion transfer photographic element of claim 1, wherein said compound (2) is present in an amount of $10^{-4}$ to 1.0 g per kg of the alkaline processing composition.

5. The color diffusion transfer photographic element of claim 1, wherein said compound (2) is present in an amount of $10^{-2}$ to 0.8 g per kg of the alkaline processing composition.

* * * * *